US008579534B2

(12) United States Patent
Kane et al.

(10) Patent No.: US 8,579,534 B2
(45) Date of Patent: Nov. 12, 2013

(54) PAGE ALIGNMENT DEVICE FOR SCRAPBOOKING

(76) Inventors: Gail A. Kane, Mt. Juliet, TN (US); Michael D. Kane, Mt. Juliet, TN (US)

( * ) Notice: Subject to any disclaimer, the term of this patent is extended or adjusted under 35 U.S.C. 154(b) by 281 days.

(21) Appl. No.: 13/044,118

(22) Filed: Mar. 9, 2011

(65) Prior Publication Data

US 2011/0219606 A1 Sep. 15, 2011

Related U.S. Application Data

(60) Provisional application No. 61/312,026, filed on Mar. 9, 2010.

(51) Int. Cl.
*B42F 13/00* (2006.01)

(52) U.S. Cl.
USPC ..... 402/24; 402/80 R; 281/22

(58) Field of Classification Search
USPC ..... 29/271, 278, 276, 280; 402/24, 80 R, 402/80 P; 281/22, 28, 51; 412/1, 6, 7
See application file for complete search history.

(56) References Cited

U.S. PATENT DOCUMENTS

| | | | | | |
|---|---|---|---|---|---|
| 233,704 | A | * | 10/1880 | Schley | 101/400 |
| 492,772 | A | * | 3/1893 | Ames | 402/67 |
| 766,364 | A | * | 8/1904 | Lawson | 402/64 |
| 1,583,036 | A | * | 5/1926 | Van Valkenburgh | 402/70 |
| 1,787,958 | A | * | 1/1931 | Schade | 402/37 |
| 1,838,383 | A | * | 12/1931 | Fridolph | 101/400 |
| 2,439,826 | A | * | 4/1948 | Snyder | 402/63 |
| 3,503,695 | A | * | 3/1970 | Giampa | 402/71 |
| 3,744,821 | A | * | 7/1973 | Abildgaard et al. | 281/21.1 |
| 4,369,013 | A | * | 1/1983 | Abildgaard et al. | 412/38 |
| 5,080,398 | A | * | 1/1992 | Groswith, III | 281/28 |
| 5,100,253 | A | * | 3/1992 | Cooper | 402/75 |
| 5,102,167 | A | * | 4/1992 | Groswith, III | 281/28 |
| 5,806,893 | A | * | 9/1998 | Wilson et al. | 281/30 |
| 5,887,900 | A | | 3/1999 | Raymond | |
| 6,418,635 | B1 | | 7/2002 | Nelson et al. | |
| 7,137,206 | B2 | * | 11/2006 | Lira-Ñiez | 33/41.2 |
| 7,305,785 | B2 | | 12/2007 | Sharp | |
| 7,374,385 | B2 | * | 5/2008 | Parker | 412/8 |
| 2006/0054519 | A1 | * | 3/2006 | Chen | 206/308.1 |
| 2006/0220372 | A1 | | 10/2006 | Shackelford | |
| 2007/0049477 | A1 | | 3/2007 | Hester et al. | |
| 2007/0124867 | A1 | * | 6/2007 | Woods et al. | 7/164 |
| 2007/0182153 | A1 | | 8/2007 | Hester et al. | |
| 2008/0179873 | A1 | | 7/2008 | Kovacevich | |
| 2009/0196710 | A1 | | 8/2009 | Hester et al. | |
| 2012/0027503 | A1 | * | 2/2012 | Chiles et al. | 402/61 |

* cited by examiner

*Primary Examiner* — David Bryant
*Assistant Examiner* — Justin Sikorski
(74) *Attorney, Agent, or Firm* — Renner Kenner Greive Bobak Taylor & Weber

(57) ABSTRACT

A scrapbooking page alignment device for temporarily aligning at least two adjacent scrapbook pages having retention receivers extending from their respective spine edges, the device comprising (i) a base; and (ii) two or more spaced retention posts extending from said base; where said retention posts are dimensioned to temporarily receive the retention receivers of the two adjacent scrapbook pages.

9 Claims, 7 Drawing Sheets

PAGE ALIGNMENT DEVICE FOR SCRAPBOOKING

This application claims priority from U.S. Provisional Application Ser. No. 61/312,026 filed Mar. 9, 2010, which is incorporated herein by reference in its entirety.

FIELD OF THE INVENTION

Embodiments of the invention relate to devices and methods to facilitate scrapbooking. More particularly, embodiments relate to devices and methods for aligning at least two adjacent scrapbook pages during construction so that one or more design elements, which may be applied across adjacent facing pages, remain aligned when the pages are subsequently inserted into a scrapbook or album.

BACKGROUND OF THE INVENTION

In general, the activity of scrapbooking involves the selection and arrangement of various design elements to form a completed layout on a scrapbook page. These design elements may include ornate embellishments, stickers, pins, tabs, or other indicia comprising various designs. In addition, customized design elements may also be handmade by the author of the scrapbook pages from various types of scrapbooking paper and other materials, such as fabric or the like.

As scrapbooking has become increasingly popular, new trends in scrapbook page layouts have evolved. For example, one trend is to utilize two or more adjacent scrapbook pages to present an enlarged layout, whereby the pages share one or more common design elements that continue across the boundary between adjacent pages. While individual pages of the finished scrapbook product are bound or tethered to each other, such as by using straps or belts, the individual pages are loose or unbound during construction of the scrapbook. As a result, the author of a scrapbook constructing an enlarged layout across two pages must carefully position and maintain the positioning of the two unbound pages during construction of the enlarged layout. In other words, while constructing the side-by-side pages, the unbound pages are desirably kept in adjacent alignment with each other so that design elements can be arranged on the respective pages in a manner that when ultimately bound, the arrangement of the design elements spanning the two pages will be aligned and aesthetically pleasing.

The ability to maintain the pages in alignment during the construction process is, however, not a trivial task. To begin with, the scrapbook pages slide on most work surfaces and therefore as the various design elements are placed, reoriented, or removed from the pages, pages placed in side-by-side alignment are often moved, thereby requiring realignment. While this problem is often alleviated by the author holding the pages in place during movement of the design elements, this complicates construction of the pages since this restricts the author from maximizing the free movement of both hands.

Furthermore, the difficulty may be aggravated by the positioning of the mounting or retention receivers used to retain the scrapbook pages in the scrapbook album. That is, these receivers may not be consistently positioned from page to page due to variances in the manufacturing process used to produce the scrapbook pages. As such, the vertical positioning of the retention receivers that extend from the spine of the scrapbook pages may differ from page to page.

Thus, when the top and bottom edges of the pages are used to align adjacent pages during construction of the pages, the alignment of the design elements may not carry through to the finished (i.e. bound) scrapbook. In other words, when the scrapbook pages are inserted into an album, any design elements shared by the adjacent pages that extend or are applied across the adjacent pages will be vertically misaligned even though the author took care to align the pages by using the top and bottom edges during the construction of the pages.

Therefore, there is a need to overcome these and other problems encountered during construction of scrapbooks, especially the enlarged, side-by-side pages of scrapbooks.

SUMMARY OF THE INVENTION

Embodiments of the invention provide a scrapbooking page alignment device for temporarily aligning at least two adjacent scrapbook pages having retention receivers extending from their respective spine edges, the device comprising a base; and two or more spaced retention posts extending from said base; where said retention posts are dimensioned to temporarily receive the retention receivers of the two adjacent scrapbook pages.

Embodiments of the invention further provide, in combination, a page alignment device and two scrapbook pages, where said alignment device include a base and at least two spaced male elements; and said two scrapbook pages each include at least two female receivers extending therefrom.

Embodiments of the invention still further provide a method of aligning adjacent scrapbook pages comprising providing a base having a plurality of spaced retention posts; providing at least two scrapbook pages having spaced retention receivers extending from their spine edge; positioning retention receivers of one page over two or more of said retention posts; and positioning retention receivers of another page over said two or more of said retention posts, such that said pages are temporarily arranged adjacent to one another secured at their spine edges; and maintaining said adjacent pages aligned as at least one design element is placed across said pages, such that said at least one design element extending across said pages remains in substantial vertical alignment when said adjacent pages are subsequently inserted in a scrapbook.

Embodiments of the invention still further provide a method of aligning adjacent scrapbook pages, the method comprising the steps of providing a base having a plurality of spaced retention posts; providing at least two scrapbook pages having spaced retention receivers extending from their spine edge; positioning retention receivers of one page over two or more of said retention posts; positioning retention receivers of another page over said two or more of said retention posts, such that said pages are temporarily arranged adjacent to one another and secured at their spine edges; and said adjacent pages in alignment as at least one design element is placed across said pages, such that said at least one design element extending across said pages remains in substantial vertical alignment when said adjacent pages are subsequently inserted in a scrapbook.

Embodiments of the invention still further provide a alignment device for use in aligning adjacent scrapbook pages during construction of the pages, the device comprising: a base having a generally planar bottom surface adapted to be positioned on a generally planar supporting surface; and two or more retaining mechanisms adapted to releasably secure the spine edges of adjacent scrapbook pages in vertical alignment during construction of the pages.

BRIEF DESCRIPTION OF THE DRAWINGS

These and other features and advantages of the present invention will become better understood with regard to the following description, appended claims, and accompanying drawings wherein:

DETAILED DESCRIPTION OF ILLUSTRATIVE EMBODIMENTS

Figure 1:
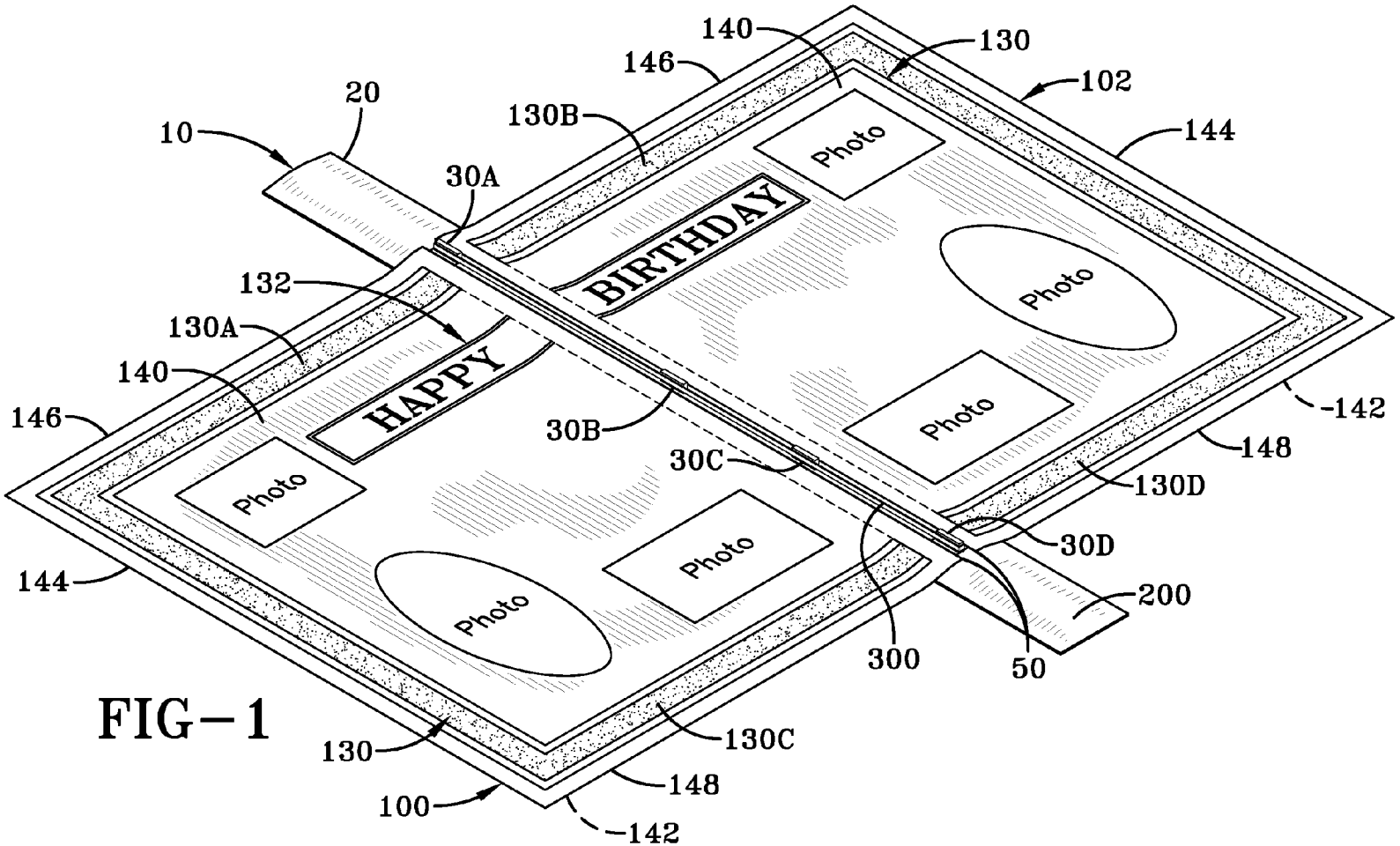
FIG. 1 is a perspective view of a page alignment device retaining two scrapbook pages adjacent to one another in accordance with the concepts of the present invention.

According to the embodiments of the present invention, a page alignment device is generally referred to by the numeral 10 in the drawings. As shown in FIGS. 1-5, page alignment device 10 includes a base 20 from which extend a plurality (i.e. two or more) of spaced retention posts 30A-D, which may also be referred to as mounting posts or male elements 30A-D. Mounting posts 30A-D temporarily mate with retention receivers 40A-B and 42A-B, which may also be referred to as female elements 40A-B and 42A-B, of conventional scrapbook pages, generally indicated by the numerals 100, 102. Mounting posts 30A-30D are vertically positioned along base 20 to maintain a pair of scrapbook pages 100,102 in vertical alignment with respect to their respective retention receivers 40A-B and 42A-B.

The page alignment device according to embodiments of the present invention offers several advantages. For example, the device can maintain a pair of pages during construction of the pages in the same vertical alignment as will exist in a bound scrap book. This is particularly advantageous when a design layout spans across two pages, and even more so when a single or integral design element spans two pages. For example, and as shown in FIG. 1, design element 130, which may be generally referred to as a border element, or the design element 132, which may be generally referred to as a word or phrase element, can be positioned during construction of the page in the same vertical alignment as they will exist in the bound scrapbook. While this could be accomplished by other means, such as the author holding the pages in alignment during construction, the device 10 frees both hands of the author to work the design elements rather than hold the pages in alignment. Additionally, the device maintains adjacent pages 100,102 in close proximity across their respective spine edges 50A, 50B, which further facilitates construction of a design layout across the two pages. Furthermore, because the device temporarily aligns the adjacent pages with respect to the retention receivers, as opposed to the top edge 104A,104B or bottom edges 106A,106B, which is the most convenient method when aligning by hand, the design elements can be positioned as they will exist in the bound scrapbook, even if there are inconsistencies in the positioning of the retention receivers from one page to the next.

Embodiments of the invention are not necessarily limited by the selection and use of any particular scrapbooking pages in combination with the alignment device of this invention. In one or more embodiments, the scrapbook pages 100,102 include a front surface 140 and a rear surface 142 that are bounded laterally by a spine edge 50 and an opposed border edge 144 that are normally substantially parallel, and a top edge 146 that is normally parallel to a bottom edge 148. Top edge 146 and bottom edge 148 are substantially perpendicular to spine 50 and border edge 144. As used herein, the term vertically refers to a direction generally parallel to spine edge 50 and border edge 144, and extending generally perpendicular to top edge 146 and bottom edge 148.

Various design elements, such as design elements 130, shown as a paper border, or word element 132, may be disposed upon the front and rear surfaces 140,142 of the pages 100,102 in a manner known in the art. It should be appreciated that the design elements 130 and 132 may comprise any indicia, design, or the like, including, but not limited to, embellishments, stickers, pins, tabs, ribbon, brads, fibers, buttons, rhinestones, or ink-stamping. Furthermore, it should be appreciated that the scrapbook pages 100,102 that are used in association with device 10 may comprise strap hinge scrapbook pages, for example.

Figure 2:
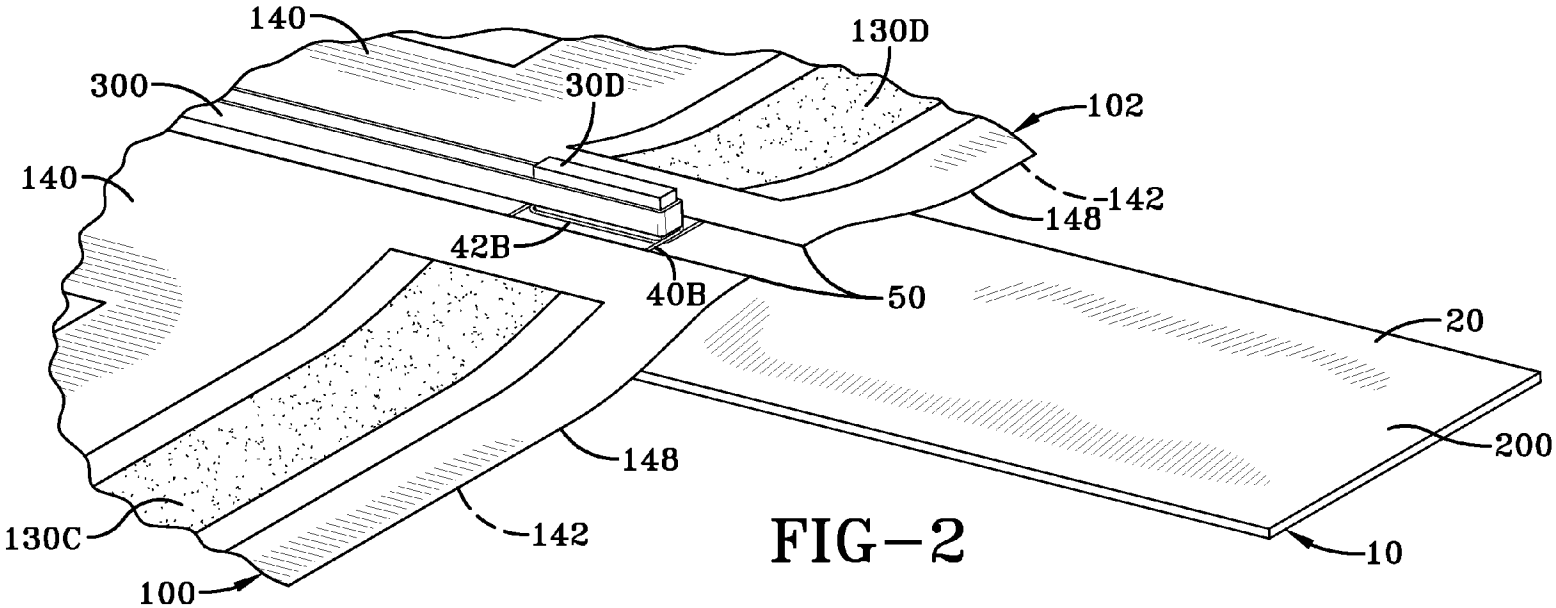
FIG. 2 is an enlarged fragmentary perspective view of the page alignment device of FIG. 1 showing the attachment of the pages to a plurality of retention posts extending from the page alignment device in accordance with the concepts of the present invention.
Figure 3:
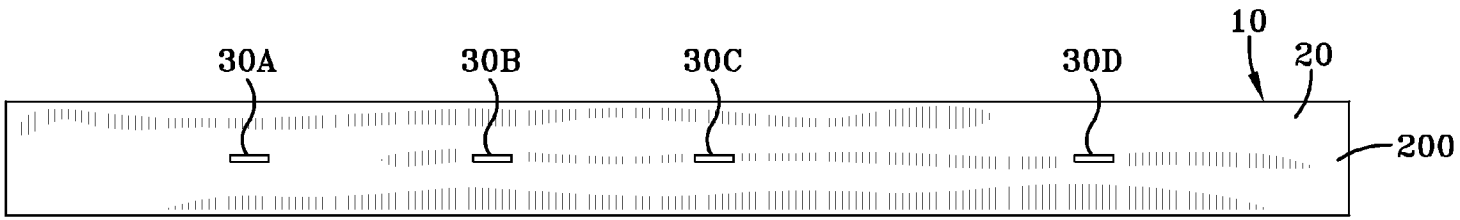
FIG. 3 is a top plan view of the page alignment device of FIG. 1 in accordance with the concepts of the present invention.
Figure 4:
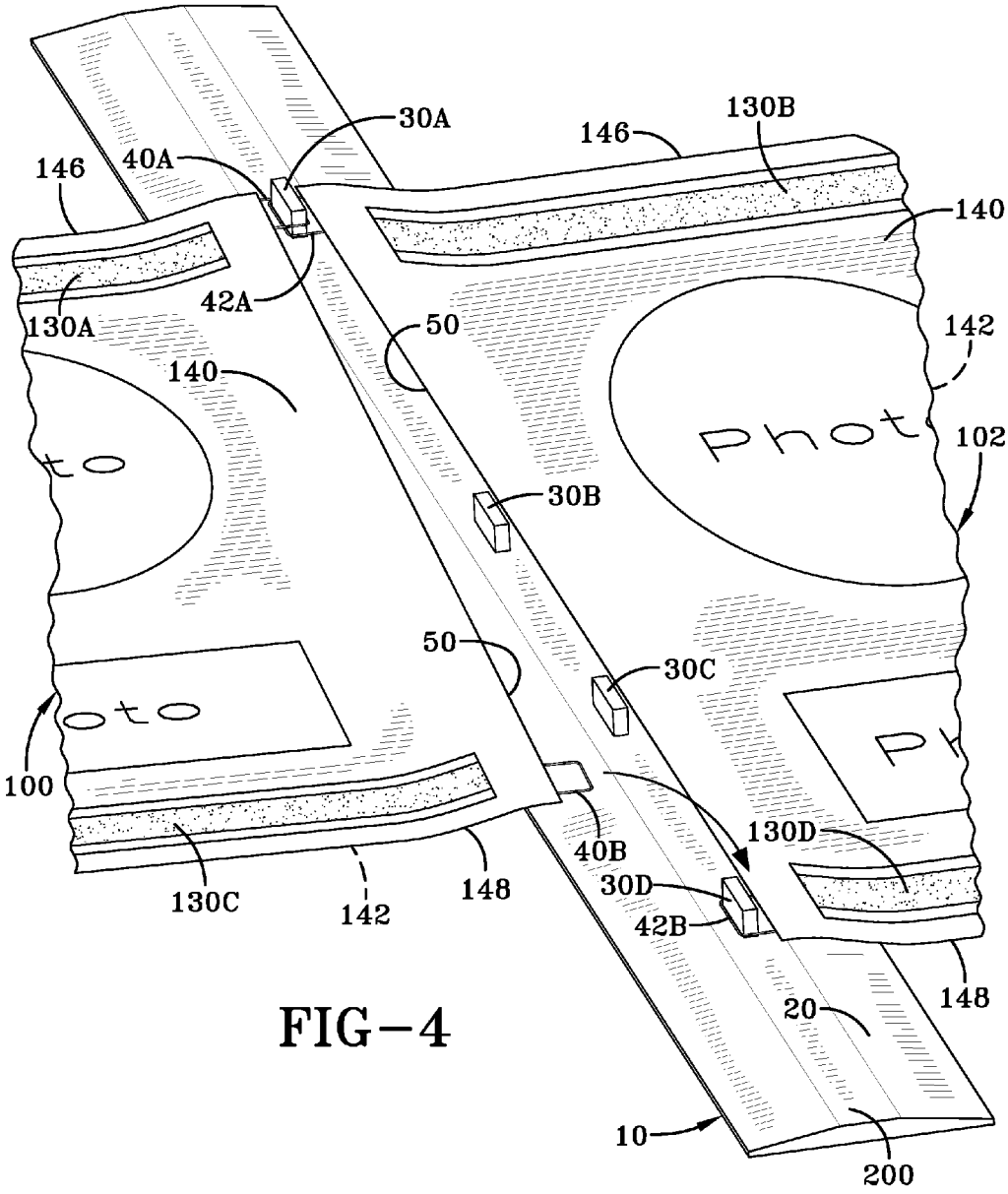
FIG. 4 is an enlarged fragmentary top plan view of the page alignment device of FIG. 1 showing a plurality of retention receivers of adjacent pages being disposed over one form of a plurality of retention posts of the page alignment device in accordance with the concepts of the present invention.

Base 20 of alignment device 10 may be formed from any suitable material such as wood, metal, or plastic, and may take on any suitable cross-sectional shape. For example, the base 20 may be formed of plastic and may have a generally rectangular cross-section. In certain embodiments, as shown in FIG. 2, base 20 has a substantially low profile (i.e. substantially minimal height), which allows placement of pages (e.g. 100,102) in a relatively flat manner and thereby minimizes interference with construction of the layout. Other cross-sectional profiles may be employed, such as a trapezoid as shown in FIG. 4. In certain embodiments, base 20 includes a generally planar bottom surface adapted to be positioned on a generally planar support surface, or "work surface." In one or more embodiments, the length of base 20 may be greater than vertical length of pages 100,102 and therefore vertically extend beyond edges 146,148 of pages 100, 102 as shown in FIG. 1. In other embodiments, the length of base 20 may be shorter than the vertical length of pages 100,102 and therefore does not vertically extend beyond edges 146,148 of pages 100, 102. Also, in certain embodiments, as shown in FIG. 3, base 20 may include ruler markings or other graduated measurement indicia, which may assist in the placement of the design elements (e.g. 130) on the pages (e.g. 100,102).

Device 10 may include any number of suitable retention or mounting posts (e.g. 30A-D). In particular embodiments, the number of retention posts corresponds to the number of retention receivers (e.g. 40,42) carried by a given scrapbook page.

Thus, while four retention posts 30A-D are shown in the FIG. 1, any suitable number of posts may be supported by base 20.

Retention posts 30A-D may be formed from any suitable material such as metal, rubber, plastic or the like.

As noted above, retention posts 30A-D may be dimensioned or otherwise shaped to receive and temporarily mate with retention elements 40,42 of pages 100,102. This goal, however, can be achieved by a variety of cross-sectional shapes or configurations for retention elements 40,42. For example, and as best shown in FIGS. 2-4, retention posts 30A-D may have a rectangular cross section. In certain embodiments, the width and length of the rectangular retention posts (e.g. 30A-D) may be smaller than the inner dimensions of retention elements 40,42. This configuration, as generally shown in FIG. 4, allows retention elements 40,42 to be mated with retention posts 30A-D by simply positioning retention elements 40,42 over posts 30A-D.

In alternative embodiments, one or more dimensions of retention posts 30A-D may be larger than the inner dimensions of retention elements 40,42. Accordingly, in these embodiments, retention elements 40,42 may be mated with retention posts 30A-D by applying a force to secure pages 100,102 in place. In other words, the dimensions of retention posts 30A-D are configured to be compressively or frictionally received within the retention receivers 40,42 of the scrapbook pages 100,102, so that the pages 100,102 are securely, yet temporarily, retained thereon. For example, retention posts 30A-D may be formed of rubberized or other compressive material, such as neoprene or foam, that deforms and under force and thereby allows retention elements 40,42, which are typically rigid in structure, to mate with posts 30A-D. In certain embodiments, the mating of retention elements 40,42 over deformable retention posts 30A-D allows frictional or compressive forces to hold the pages 100,102 in place, thereby preventing them from being inadvertently displaced from the device 10.

Figure 5B:
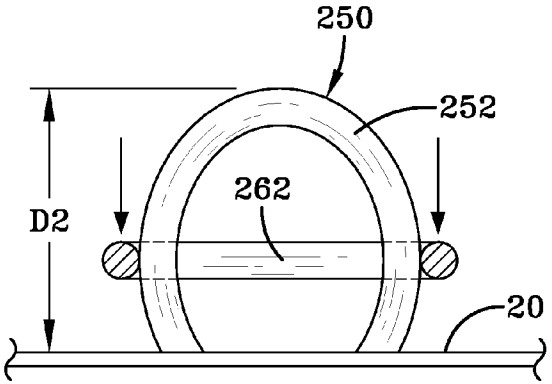
FIGS. 5A, 5B, and 5C are perspective side views of retention posts in accordance with the alternative embodiments of the present invention.
Figure 5A:
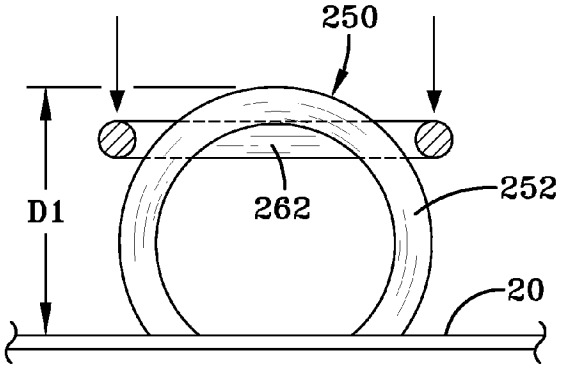
Figure 5C:
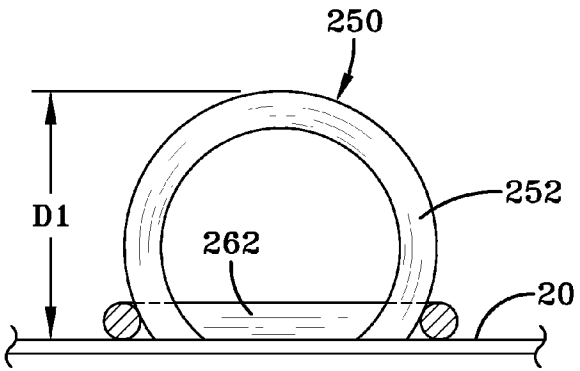

In particular embodiments, as specifically shown in FIG. 5, retention posts 30A-D are deformable rings 250, which may include deformable ring or curved portion 252 (e.g. a curved section of solid or hallow tubing) attached, directly or indirectly, to base 20 at ends 254,256. According to these embodiments, the application of force downward on deformable rings 250 (i.e. in a direction perpendicular to base 20, by retention element 262 (akin to retention elements 40,42) may deform ring portion 252 to allow retention element to mate with deformable ring 250. As specifically shown in FIG. 5B, retention element 262 compresses ring 252 to allow passage of retention element 262 beyond the diameter of the ring 252 to a location adjacent base 20 as shown in FIG. 5C. in these or other embodiments, deformable ring 250 may be compressed, such as by a pinching force with one's fingers, to allow retention elements 262 to mate therewith.

Other configurations for retention posts 30A-D are contemplated. For example, the posts may include one or more moveable elements. For example, it may be desirable to displace retention posts 30A-D after retention posts 30A-D are mated with retention receivers 40,42. Accordingly, posts 30A-D may be deformable so that they can be manipulated out of the way or they may include multiple elements with a pivot point that allows one or more elements of the posts 30A-D to be moved or displaced after mating with retention receivers 40,42.

Figure 6:
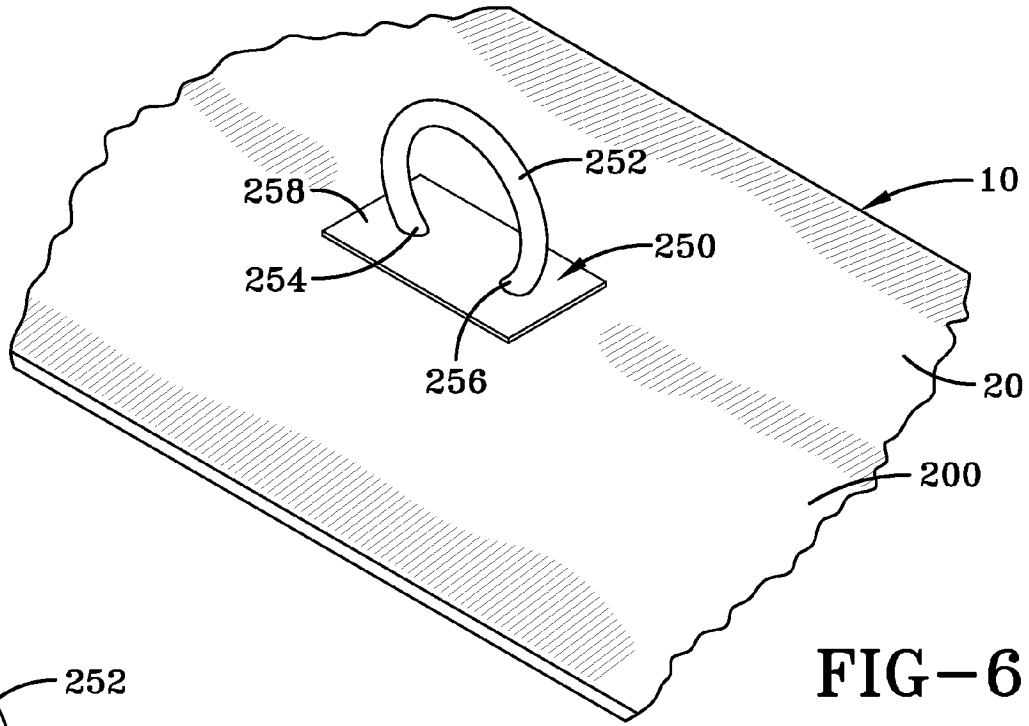
FIGS. 6 and 6A are fragmentary perspective views of a page alignment device of FIG. 1 having an alternative form of retention posts in accordance with alternative embodiments of the present invention.
Figure 6A:
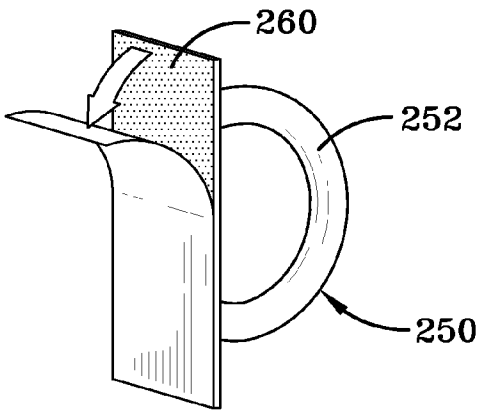
Figure 7:
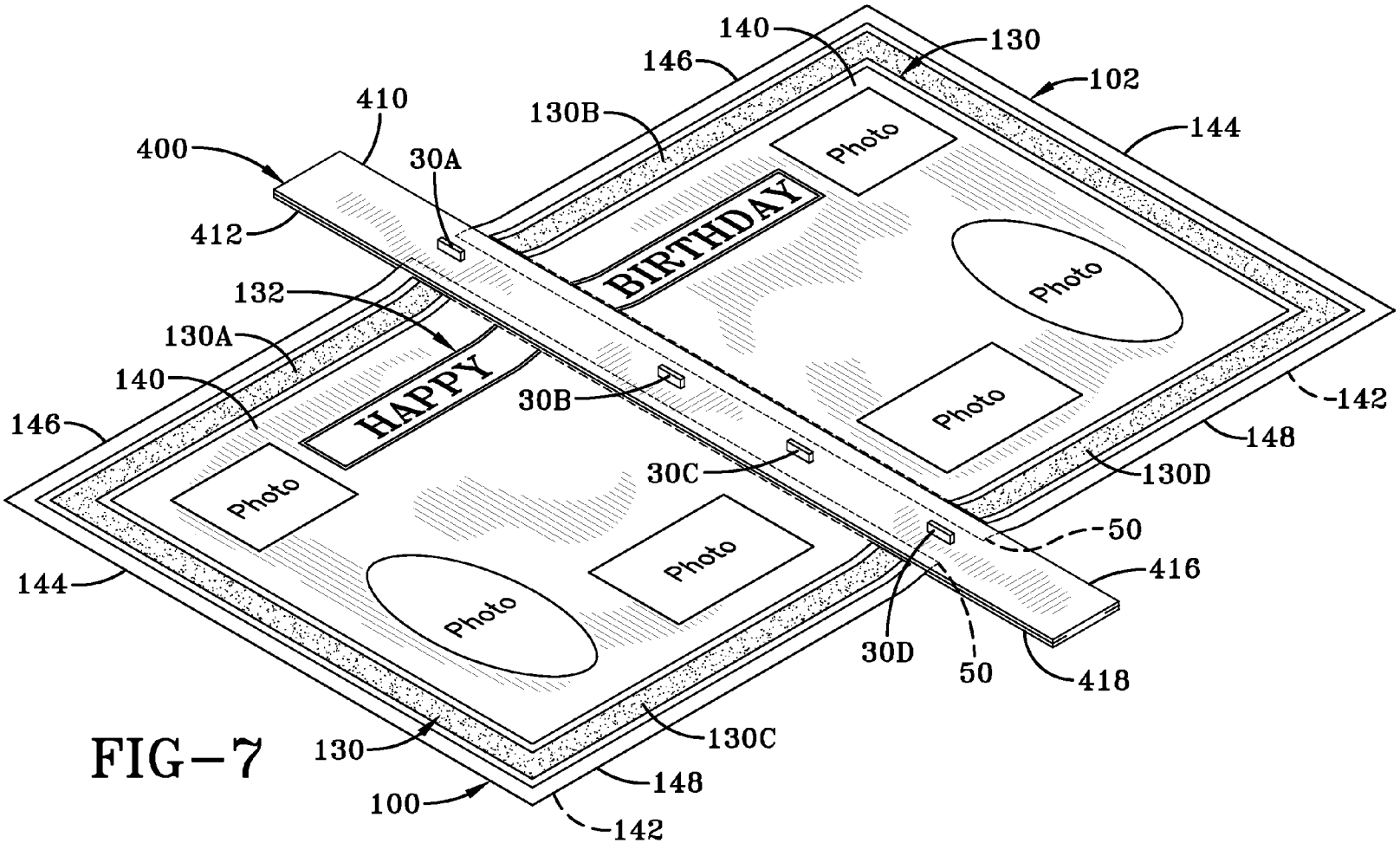
FIG. 7 is a perspective view of an alignment device and adjacent scrapbook pages according to the concepts of an alternative embodiment of the invention.

In one or more embodiments, retention posts 30A-D may be indirectly attached to base 20. For example, as shown in FIGS. 6 and 6A, device 10 may utilize a retention post 250, which includes ring or curved section 252 attached at each end 254,256 to an intermediary base 258. This intermediary base 258 may then be affixed to base 20. Any suitable means of fixing intermediary base 258 to base 20 may be used including an adhesive or a thermal weld, for example. In one aspect, intermediary base 258 includes an adhesive surface 260 for attaching the retention post 250 to the base 20.

In an alternative embodiment of the invention, as shown in FIGS. 7 and 8A-8C, a page alignment device 400 may be adapted to retain the spine edges 50 of scrapbook pages 100, 102 that do not include retention receivers. In certain embodiments, scrapbook pages do not include retention receivers, and are bound into a scrapbook by alternate means. However, the same difficulties regarding page alignment apply to these scrapbook pages as to the scrapbook pages with retention receivers. Thus, alignment device 400 is configured to receive and retain the spine edges 50 of these scrapbook pages 100, 102 to maintain the desired vertical alignment during construction of the pages.

Alignment device 400 includes a longitudinally extending base 410 having a top planar surface 412, a bottom planar surface 414, a first lateral edge 416, and a second lateral edge 418. In certain embodiments, base 410 has a substantially low profile (i.e. substantially minimal height), which allows placement of pages (e.g. 100,102) in a relatively flat manner and thereby minimizes interference with construction of the layout. In certain embodiments, bottom planar surface 414 is adapted to be positioned on a generally planar work surface. In one or more embodiments, base 410 has a longitudinal length approximately equal to the vertical length of scrapbook pages 100, 102. In other embodiments, base 410 may have a longitudinal length that is less than the vertical length of scrapbook pages 100, 102. In yet other embodiments, base 410 may have a longitudinal length that is greater than the vertical length of scrapbook pages 100, 102.

In one or more embodiments, alignment device 400 may include a polymeric material. In certain embodiments, alignment device may include a flexible and resilient material that can be deformed but will return to its original position. The flexibility and resiliency of the alignment device allows pages to be inserted into the device, and retained by the device, without damaging the pages, as will be appreciated from the discussion to follow. In other embodiments, alignment device may be made of other suitable non-flexible materials, such as, for example, wood, metal, and plastic.

Figures 8A, 8B, 8C:
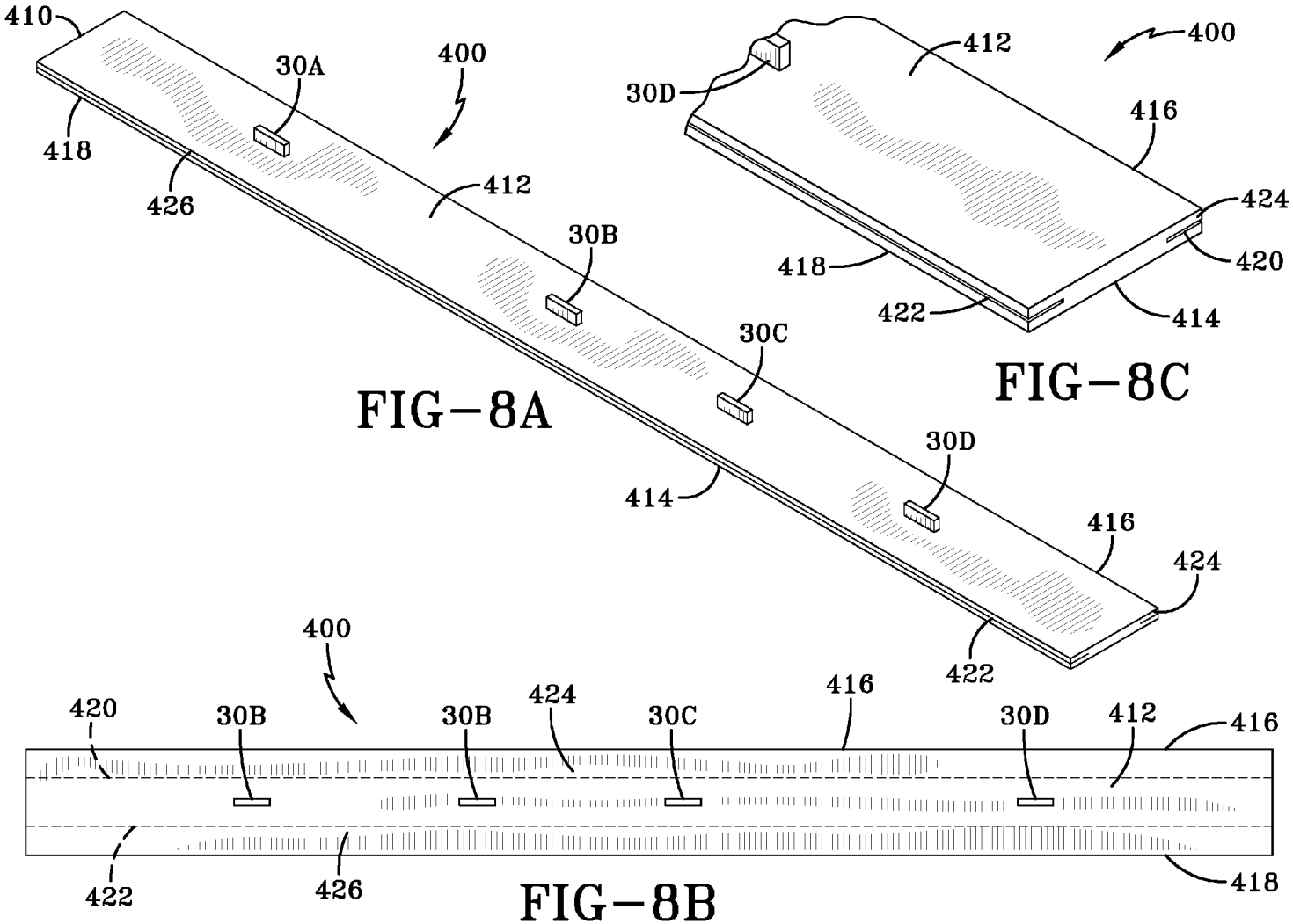
FIG. 8A is a perspective view of the alignment device of FIG. 7.
FIG. 8B is a top elevational view of the alignment device of FIG. 7.
FIG. 8C is an enlarged fragmentary perspective view of the alignment device of FIG. 7.

In one or more embodiments, and as best shown in FIGS. 8A-8C, alignment device 400 includes a first slot 420 extending longitudinally along the length of first lateral edge 416, and a second slot 422 extending longitudinally along the length of second lateral edge 418. First slot 420 and second slot 422 each extend less than half the lateral width of base 410 so that a center portion of base 410 contains no slot therethrough. First slot 420 forms a top flap 424 in first lateral edge 416, and second slot 422 forms a top flap 426 in second lateral edge 418. As will be appreciated by those skilled in the art, where base 410 is flexible or resilient top flaps 424, 426 can flex or deform to allow insertion of spine edges 50 of scrapbook pages 100, 102. In certain embodiments, the flaps may be lifted to allow insertion of the spines of the scrapbook pages. Once released, top flaps 424, 426 return to their original position and act to "squeeze" or retain the pages within the alignment device 400. In other embodiments, where base 410 is made of a rigid material (e.g., plastic), slots 420, 422 are generally fixed and pages 100, 102 can be slid or inserted into slots 420, 422.

In one or more embodiments, alignment device 400 may include retention posts 30A-D as discussed with respect to alignment device 10 and FIGS. 1-6. Thus, a single alignment device 400 may provide for alignment of scrapbook pages having retention receivers, and scrapbook pages without retention receivers. The retention posts 30A-D of alignment device 400 may be the same as retention posts 30A-D of alignment device 10, and may be dimensioned and shaped accordingly.

In certain embodiments, a retaining member may be provided to further secure scrapbook pages 100, 102 in place. The retaining member may be any weighted object that acts to further secure the pages received within slots 420 and 422 against movement. In one or more embodiments, the retaining member may include a hole that receives one of posts 30A-D therethrough to secure the retaining member to alignment device 400. In certain embodiments, retaining member may be an elongated member that extends from one scrapbook page 100, 102, over alignment device 400 and onto the other scrapbook page 100, 102. In one or more embodiments, the retaining member may include markings or indicia thereon to assist in the assembly of the scrapbook page, such as, for example, ruler markings.

As discussed above, the device of the present invention is highly advantageous when placed in combination with one or more scrapbooking pages. In one or more embodiments, when the retention receivers 40,42 of pages 100,102 are attached to or mated to device 10, pages 100,102 can be easily worked by a person constructing a scrapbook. Practice of the present invention is particularly advantageous when a design layout spans two adjacent pages since the device frees both hands of the person constructing the scrapbook. And, by temporarily holding the pages 100,102 based on the vertical alignment of retention receivers 40,42, design elements can be arranged in the same manner as they will appear within the scrapbook. Moreover, the device temporarily maintains the adjacent scrapbook pages in proximity to each other along their respective spine edges (e.g., respective edges 50). In other words, inasmuch as the respective retention receivers of each scrapbook page sharing a common vertical alignment (e.g., 40B and 42B as shown in FIG. 2) are each mated to a common retention post (e.g., 30D in FIG. 2). The respective spine edges are temporarily maintained in close proximity (e.g, proximately abutted to each other). This proximate arrangement may advantageously facilitate placement of design elements spanning the respective pages (e.g., design element 132 shown in FIG. 1).

Still further, the device addresses and compensates for the possible inconsistent positioning of retention receivers 40,42 of adjacent pages 100,102. In other words, while retention receivers 40,42 of each page 100,102 are generally positioned vertically on spine edge 50 of pages 100,102 in a consistent manner, device 10 compensates for any variation in the vertical positioning of retention receivers 40,42 of adjacent pages 100,102, as may occur in various manufacturing processes. Thus, design elements 130A,130B and 130C,130D that are shared or otherwise disposed across spine edge 50 of two adjacent pages 100,102 when they are retained by device 10, remain in alignment when pages 100,102 are subsequently placed into a scrapbook.

As should be evident from the description above, during the use of device 10, the author of the scrapbook page places the retention receivers 40A-B and 42A-B of respective pages 100,102 over retention posts 30A and 30D, as shown in process in FIG. 4. In particular, page 100 is attached to device 10, such that retention receivers 40A-B are received by retention posts 30A and 30B, respectively, while page 102 is attached to device 10, such that retention receivers 42A-B of page 102 receive respective retention posts 30A and 30B. As such, retention receivers 40 and 42 are positioned so that they are adjacent one another, and as a result, pages 100,102 are vertically aligned, as they would be in a scrapbook album or binder. This allows the author to place design elements 130, such as 130A-B and 130C-D, that extend or continue across pages 100,102 so that they are kept vertically aligned. Thus, during the creation of the scrapbook layout, when pages 100,102 are removed from alignment device 10 and subsequently inserted into a scrapbook album or binder, they remain in vertical alignment.

Furthermore, once pages 100,102 have been attached to device 10, a retainer 300, such as a rubber band, may be attached to one or more of retention posts 30, as shown in FIGS. 1 and 2, to prevent retention receivers 40,42 from inadvertently slipping off of retention posts 30A and 30B as the author is implementing a desired scrapbook design. For example, in embodiments where retainer 300 comprises a rubber band, the rubber band may be stretched so that it is anchored at two points defined by retention posts 30A and 30D, to hold retention receivers 40,42 of respective pages 100,102 to retention posts 30A and 30D. Similarly, it is also contemplated that a weighted object may be placed over and around posts 30A and 30D to hold retention receivers 40,42 of respective pages 100,102. For example, in certain embodiments a weighted doughnut-shaped anchor member may be positioned around posts 30A and 30D and over retention receivers 40,42 to maintain pages 100,102 in the desired position.

Thus, device 10 is advantageous in that it facilitates authors of scrapbook pages to be able to arrange design elements across adjacent pages 100,102 so that common design elements that extend across the pages remain aligned when placed inside a completed album. As such, the aesthetic appearance of the common design elements, such as 130, disposed across adjacent scrapbook pages 100,102, is preserved.

Although the present invention has been described in considerable detail with reference to certain embodiments, other embodiments are possible. Therefore, the spirit and scope of the appended claims should not be limited to the description of the embodiments contained herein.

What is claimed is:

1. An alignment device for use in aligning adjacent scrapbook pages during construction of the pages, the device comprising:

(i) a longitudinally extending base having a top planar surface, a bottom planar surface, a first lateral edge, and second lateral edge;

(ii) at least two retaining posts disposed on said top planar surface, said retaining posts adapted to releasably secure the scrapbook pages;

(iii) a first slot extending longitudinally along the length of said first lateral edge; and (iv) a second slot extending longitudinally along the length of said second lateral edge.

2. The alignment device of claim 1, where said retaining posts are adapted to receive retention receivers extending from the spine edges of the scrapbook pages.

3. The alignment device of claim 1, where said retaining mechanisms include a hoop structure adapted to receive retention receivers extending from the spine edges of the scrapbook pages.

4. The alignment device of claim 1, where said base is made of a flexible and resilient material.

5. The alignment device of claim 1, where each of said slots extend through less than half of said base.

6. The alignment device of claim 1, said top planar surface further including graduated measurement indicia.

7. The alignment device of claim 1, where said first slot forms a first top flap in said first lateral edge and said second slot forms a second top flap in said second lateral edge.

8. The alignment device of claim 7, where said first top flap and said second top flap are deformable.

9. The alignment device of claim 8, where said slots are adapted to allow insertion of the spine edges of the scrapbook pages to thereby maintain the scrapbook pages in vertical alignment with the spine edges in close proximity to each other.

* * * * *